US006467159B2

(12) United States Patent
Shimai et al.

(10) Patent No.: US 6,467,159 B2
(45) **Date of Patent: *Oct. 22, 2002**

(54) FASTENER-CHAIN-FINISHING APPARATUS

(75) Inventors: Hideo Shimai; Hideki Akiyama, both of Toyama-ken (JP)

(73) Assignee: Ykk Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/375,193

(22) Filed: Aug. 16, 1999

(65) Prior Publication Data

US 2001/0054220 A1 Dec. 27, 2001

(30) Foreign Application Priority Data

Aug. 25, 1998 (JP) ..... 10-238210

(51) Int. Cl.[7] ..... A41H 37/06
(52) U.S. Cl. ..... 29/767
(58) Field of Search ..... 29/767, 33.2, 408, 29/766

(56) References Cited

U.S. PATENT DOCUMENTS 3,763,546 A 10/1973 Perlman

FOREIGN PATENT DOCUMENTS

| | | |
|---|---|---|
| EP | 0 065 318 | 11/1982 |
| EP | 0 129 757 | 1/1985 |
| EP | 0 143 387 | 6/1985 |
| FR | 1 561 401 | 3/1969 |
| GB | 2 199 367 | 7/1988 |

*Primary Examiner*—P. W. Echols
(74) *Attorney, Agent, or Firm*—Finnegan, Henderson, Farabow, Garrett & Dunner, LLP

(57) ABSTRACT

In the fastener-chain-finishing apparatus, only a knockout among plural members arranged below a fastener-chain-transfer path of a space-forming unit can move up and down but all the other members are not movable. Consequently, the units below the chain-transfer path can be compact. Further, main bodies of movable grippers and a punch of the space-forming unit, which have a length equal to a space-forming length of the fastener chain and are arranged above the chain-transfer path, have end surfaces that are exposed outside and are flush with each other at least on a side of a stopper-attaching unit arranged adjacent to them. As a result, all the operating members of the space-forming unit can be arranged so as to contact with the stopper-attaching members of the stopper-attaching unit. Therefore, it is possible to form a space on the slide fastener chain to which particularly coil-shaped continuous coupling elements are attached by sewing thread, simultaneously with attachment of the stopper, which was conventionally impossible to achieve.

5 Claims, 10 Drawing Sheets

FASTENER-CHAIN-FINISHING APPARATUS

BACKGROUND OF THE INVENTION

1. Field of the Invention

The present invention relates to a finishing apparatus which is suitable particularly for a fastener chain to which coil-shaped continuous synthetic resin elements are attached ,by sewing, along a side edge of a fastener tape. More particularly, it relates to a finishing apparatus for fixing stoppers to the fastener chain in its length-wise direction at predetermined intervals and simultaneously removing a group of the elements with a predetermined length so as to form spaces at positions adjacent to the stopper attached positions.

2. Description of the Related Art

Conventionally, a finishing apparatus for succesively attaching stoppers to a fastener chain transferred intermittently and for simultaneously forming spaces on the fastener chain successively, has been disclosed, for example, in Japanese Patent Publication No. 59-51819 or Japanese Patent Publication No. 63-18482 and reduced to practice. However, any of such finishing apparatuses is for finishing a fastener chain where metallic elements are attached to a fastener tape thereof, but is not for finishing a fastener chain where coil-shaped continuous fastener elements are attached to a fastener tape thereof by sewing.

It is necessary to have positions of the fastener chain where the stoppers are attached close to positions where the spaces are formed as close as possible. Therefore, the above-mentioned finishing apparatus includes a stopper-attaching unit and a space-forming unit arranged so as to be close to each other as much as possible.

Because an object to be processed is a fastener chain in which metallic elements have been planted, the stopper-attaching unit and the space-forming unit can be thus arranged so as to be close to each other so that the stopper attaching position and the space forming position in the fastener chain can be close to each other. However, in the case where a fastener chain where synthetic resin coupling elements formed into a continuous coil shape are sewn on a fastener tape thereof is processed, the above-mentioned finishing apparatus cannot be put into practical use only by changing its design.

Namely, in the fastener chain having such kind of metallic coupling elements, the respective coupling elements are planted by caulking their leg portions onto the side edge of the fastener tape, and are made of metal that does not have viscosity and flexibility. As a result, the coupling elements can be removed from the fastener tape easily only by cutting one of the leg portions of each element. Naturally, that the coupling elements are cut to be removed from the fastener tape easily renders an element-cutting-removal mechanism so simple as disclosed in the above publications. For example, a basic element-cutting-removal mechanism for metallic elements represented by the mechanisms disclosed in the above publications is provided with a punch and a die for forming spaces that are respectively arranged above and below the fastener chain, which requires no other special operating members. Further, a transfer surface of the chain in the attached position of the die can be used as a die, so that only the punch may be operated up and down.

Meanwhile, as disclosed in the above publications, a stopper-attaching unit cuts a wire material transferred intermittently into a dimension of the stopper in a position above the stopper attaching position of the fastener chain and bends the wire material into U-shape, and presses the wire material from above astride of a row of the coupling elements of the fastener chain, and allows the wire material to pierce through a fastener tape and simultaneously bends its leg portions inwardly on lower surfaces of the fastener tapes so as to fix the wire material to the fastener chain. Such. operations are performed by synchronously cooperating up-and-down motion of a cutting punch, arranged above a fixed die formed on a base composing a fastener-chain-transfer path in the stopper-attaching unit, with forward-and-backward motion of a bender along the chain-transfer direction.

Therefore, the space-forming unit, which forms a space by removing the metallic coupling elements from the fastener chain in a predetermined length thereof, and the stopper-attaching unit , which attaches the stopper to a position close to the space, are composed of a small number of operating members which perform a simple operation above the base composing the transfer surface of the fastener chain. Thus, it is not specially difficult to arrange both the units so close to each other.

However, in the fastener chain with the coil-shaped coupling elements made of synthetic resin attached to the fastener tapes thereof by sewing thread, if only coupling head portions of the elements are simply cut, the leg portions are still held by the sewing thread. Such removal of coupling elements are disclosed, for example, in Japanese Patent Publication No. 63-48521. This Publication discloses a space-forming unit including: a pair of upper fixed grippers spaced from each other in a lateral direction; a pair of lower movable grippers spaced from each other in the lateral direction, which are movable up and down with respect to the. upper grippers and nip opposite fastener tapes of a fastener chain with the fastener elements facing upward, in cooperation with the upper fixed grippers when the lower grippers are lifted up; a fixed die arranged between the lower movable grippers and having a cutting edge portion at its upper portion thereof; a knockout for passing through the fixed die and moving up and down between the lower grippers and between the upper grippers; and a punch arranged above the knockout so as to face the knockout for pushing down the coupling head portions of the fastener elements at the time of being processed.

The space-forming unit having the above structure cuts and removes the coil-shaped continuous coupling elements from the fastener chain in such a manner as follows. After the opposite fastener tapes of the fastener chain are nipped by the upper grippers and lower grippers in a state where the coupling elements are coupled with each other and face upward, the coupling-head-portion-sides of the fastener elements are pushed down by the punch so as to be exposed between the fastener tapes to the cutting edge portion of the fixing die. When the punch is further lowered, the lower portions of the exposed coupling head portions of the opposite coupling elements are cut by the cutting edge portion of the fixed die which is in a stand-by position below the coupling head portions, and the cut fastener elements are pushed up as being nipped by the punch and the knockout, and residual portions of the cut elements are drawn out of loops of the sewing thread so as to be removed from the fastener tape.

In order to cut and remove the parts of such coil-shaped fastener elements made of synthetic resin from the fastener chain to which the fastener elements are attached by the sewing thread, it is necessary to arrange a plurality of operating members at positions above and below the transferring surface of the fastener chain, and to synchronously actuate these operating members so as to be co-operated with each other. For this reason, a driving section for actuating the operating members must be provided in or below the base. Further, there is a limit in compactly designing a lot of members and apparatuses arranged in such a manner, thus it is extremely difficult to provide all the members including supporting sections for the respective members within a dimensional limit of the operating members. Particularly since the lower grippers, in side of which the knockout moves up and down, needs to have a function for guiding the knockout inside thereof, the lower grippers are necessarily designed so as to surround a circumference of the knockout. As a result, the lower grippers are extended to an outer side a space-forming area of the slide fastener chain in the longitudinal direction thereof, which is determined by the dimension of the knockout. Thus, a distance between the space and the stopper becomes longer by this extended length, and thus the stopper-attaching unit cannot be installed so as to be close to the space-forming area.

SUMMARY OF THE INVENTION

The present invention has been made in order to solve conventional problems, and its particular object is to provide a finishing apparatus where a space-forming unit and a stopper-attaching unit are arranged so that spaces can be formed in a fastener chain to which coil-shaped continuous coupling elements are attached and simultaneously stoppers can be attached to the fastener chain at positions close to the spaces.

The object can be achieved by a fastener-chain-finishing apparatus, comprising: a chain-supply means for intermittently supplying a continuous fastener chain in which a pair of rows of coupling elements in a coil shape are attached along inner side edges of a pair of opposite fastener tapes by sewing; a stopper-attaching unit which is arranged on a transfer path of the fastener chain and fixes stoppers to the supplied fastener chain at a predetermined interval; and a space-forming unit which is arranged adjacent to the stopper-attaching unit at the transfer path of the fastener chain and removes the coupling elements of a predetermined length from the fastener chain, wherein the stopper-attaching unit includes a forming die arranged on a base and composing one part of the fastener-chain-transfer path, a bender for advancing and retreating along the fastener chain with respect to a supporting portion of a wire material for forming stoppers, and cutting punches for cutting the wire material supplied onto the bender into a predetermined length and a shape, a forming punch arranged so as to face the forming die for moving up and down with respect to the forming die so that a cut wire material piece can be formed into a stopper shape and for simultaneously installing the stopper to the fastener chain, the space-forming unit includes a pair of fixed grippers fixed to a base, spaced from each other in a lateral direction of the fastener-chain-transfer path and composing a part of the fastener-chain-transfer path, a pair of movable grippers spaced from each other in the lateral direction and being movable up and down with respect to the fastener-chain-transfer path in cooperation with each other, a pair of opposite fixed fixed cutters arranged between the pair of opposite fixed grippers and having cutting edge portions. at their upper portions, a knockout for passing through the opposite fixed cutters and moving up and down between the fixed grippers and between the movable grippers, and a punch arranged so as to face the knockout and being movable up and down independently between the opposite movable grippers so as to push down coupling head portions of the coupling elements at the time of processing, and wherein all the lengths of respective members, namely, the fixed grippers, the movable grippers, the fixed cutters, the knockout and the punch in a direction of the fastener-chain-transfer path are set to be substantially equal to a length dimension of a space-forming area of the fastener chain, and end surfaces of those members at least on one side thereof share common vertical surfaces with one-side end surfaces of the stopper-attaching unit adjacent to the members in the direction of the chain-transfer path.

Namely, according to the fastener-chain-finishing apparatus of the present invention, particularly in the space-forming unit, only the knockout among the plural members arranged below the chain-transfer path is movable up and down but all the other members are fixed in their positions so as not to move. As a result, excessive units for driving the members are not required, and thus the units below the chain-transfer path can be compact. Meanwhile, since the movable grippers and punch main body, which have lengths substantially equal to the space-forming length of the fastener chain, have end surfaces at least one side in the chain-transfer direction that are exposed outside, the end surfaces can come to contact with the end surface of the stopper-attaching unit arranged adjacent to them. Therefore, different from the conventional mechanism for cutting and removing metallic coupling elements in a space-forming area of the fastener chain, a stopper and a space can be simultaneously and accurately formed in predetermined positions in the fastener chain to which coil-shaped coupling elements are attached by sewing thread, in spite that it needs a complicated structure and a lot of operating members.

In addition, it is preferable that the opposite movable grippers and the punch of the space-forming unit respectively have slide lever sections for moving up and down along inner wall surfaces of a cylindrical guide member having an end surface at a side of the vertical surfaces, and gripper main bodies and a punch main body that are respectively joined perpendicularly to lower ends of the lever sections and are extended to end surfaces of the vertical surface side. Further preferably, the cutting punches of the stopper-attaching unit are provided to be slidable against the end surface of the cylindrical guide member at the vertical surface side. Furthermore, it is preferable that the slide lever sections of the movable grippers have angular cylindrical shapes where their upper ends are opened, and lower ends of springs are fixed in hollows of the slide lever sections, and upper ends of the springs are fixed to a retainer.

Further preferably, the cylindrical guide member of the space-forming unit and the cutting punches of the stopper-attaching unit are actuated by one fluid pressure cylinder. In this case, the stopper-attaching unit and the space-forming unit can be easily driven synchronously, and the units can be further compact.

DETAILED DESCRIPTION OF THE PREFERRED EMBODIMENTS

Figure 12:
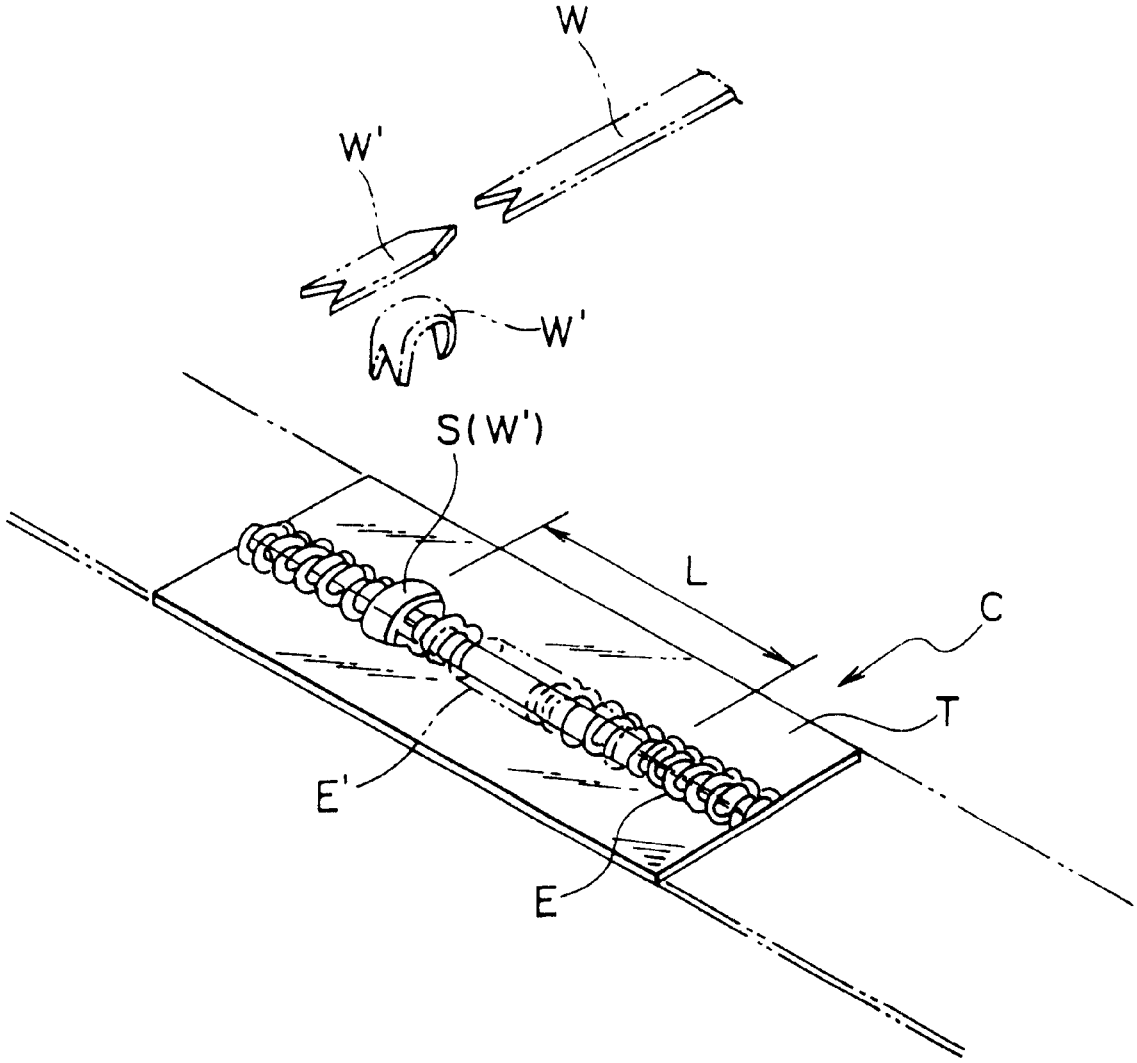
FIG. 12 is a partial perspective view showing an embodiment of the fastener chain after the stoppers are attached by the stopper-attaching unit and the spaces are formed by the space-forming unit.

The present invention relates to a fastener-chain-finishing apparatus which is suitable particularly for finishing a fastener chain to which rows of coil-shaped fastener elements made of synthetic resin are attached to opposite fastener tapes thereof by sewing thread. As shown in FIG. 12, this finishing apparatus is designed specially so as to cut and remove the fastener elements in a predetermined length at a space-forming position on the fastener chain and simultaneously attach a stopper to a stopper-attaching position on the slide fastener chain which is close to a position where the fastener elements have been cut and removed.

Embodiments of the present invention will be concretely described below with reference to the drawings.

FIGS. 1 through 4 are structural views schematically showing a main section of the fastener-chain-finishing apparatus according to a first embodiment of the present invention. The illustrated embodiment is only a most suitable and particular example, and various modification can be made by a person skilled in the art.

An apparatus 1 of the present invention comprises: a chain-supply unit 10 for intermittently transferring a long fastener chain C, per predetermined length, to which opposite continuous coupling elements E in a coil shape are attached along confronting side edges of a pair of opposite fastener tapes T of the slide fastener chain C by means of sewing thread; a stopper-attaching unit 100 which is arranged on a transfer path of the fastener chain C and fixes a stopper S to the supplied fastener chain C at predetermined intervals; and a space-forming unit 200 which is arranged in the transfer path of the fastener chain C at a position close to the stopper-attaching unit 100 and removes the coupling elements E of a predetermined length from the fastener chain C.

The chain-supply unit 10 does not necessarily have a structure peculiar to the present invention, so it may be a transfer means having a known mechanism.

Figure 4:
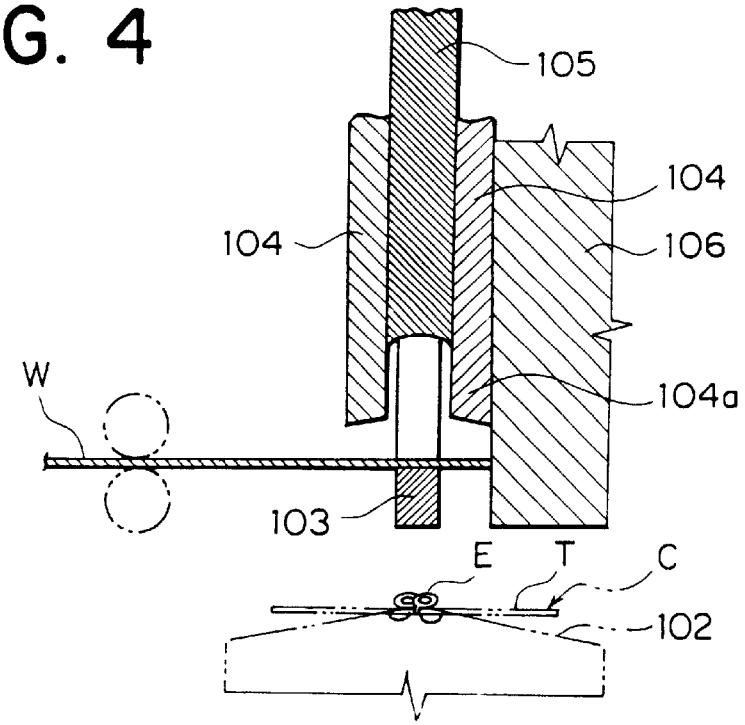
FIG. 4 is a view for explaining operations of respective members when attachment of a stopper is started by the stopper-attaching unit

As shown in FIG. 4, a block-shaped forming die 102 composing a part of the fastener-chain-transfer path is fixed to a base 101 of the stopper-attaching unit 100. Just above the forming die, a wire material W for forming stoppers S, which is supplied intermittently and perpendicularly to the fastener chain C, is supported on a bender 103 of a substantially rectangular cross section, which is arranged along the fastener chain C, facing a supported portion of the wire material W so as to be movable forward and backward.

Figure 5:
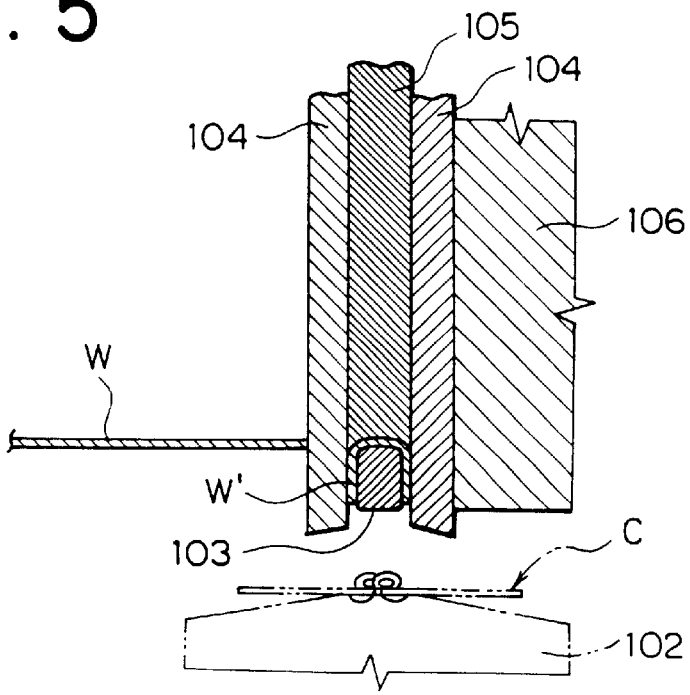
FIG. 5 is a view for explaining the operations of the members when a wire material to be stoppers is cut and bent by the stopper-attaching unit

Moreover, cutting punches 104, which cut the wire material W supplied across an upper surface of the bender 103 into a length and a form required for the stopper S, are arranged so as to be movable up and down with the bender 103 nipped therebetween. As shown in FIGS. 4 and 5, the cutting punches 104 move down and cut the wire material W to be a wire material piece W' and simultaneously bend the wire material piece W' on the bender 103 into a substantially U shape. At this time, the forming punch 105 is lowered together with the cutting punches to press the cut wire material piece W' from above and to form it into a stopper shape on the forming die 102 and fix it to a stopper-attaching position of the fastener chain C. During this lowering of the forming punch 105, the bender 103 retreats from the supporting position of the wire material W. An upper surface of the forming die 102 is formed into a hill-like shape, and a plurality of ribs are projected from its slanted surface along a transfer direction of the fastener chain C. Moreover, the forming punch 105 is provided so as to be movable up and down between the cutting punches 104 with respect to the forming die 102.

This stopper-attaching unit 100 is not essentially different from the conventional mechanism, and further an interlocking mechanism of the cutting punches 104 and the forming punch 105 is essentially the same as the mechanism disclosed in Japanese Patent Publication No. 59-51819, for example. However, the mechanism in the present embodiment is different from that in the above-mentioned publication in that the operation of the bender 103 is directly interlocked with the operation of the cutting punches 104 via a cam mechanism. This interlocking mechanism will be described below in detail based on FIGS. 1 and 4 through 7.

Each of lower end portions of the cutting punches 104 branch into a pair of right and left cutting edge portions 104*a* which are parallel with each other. They are slid and guided so as to be movable up and down by facing end surfaces of a column 106 arranged on the base 101 so that the cutting edge portions 104*a* can further move down without interfering with the upper surface of the bender 103. Lower surfaces of a pair of the opposite cutting edge portions 104*a* are slanted with their inner sides spreading so that the slanted surfaces match for the hill-like surface of the block-shaped forming die 102 fixed to the base 101. Moreover, in the column 106, a driving block 107 is fitted at upper portions of the cutting punches 104 so as to slide up and down. A fitting groove into which the forming punch 105 is fitted is formed in the end surface of the block 107, and the forming punch 105 fitted into the fitting groove is fixed to the block 107 via a bolt.

Each of the paired cutting edge portions 104*a* has a fork shape. The cutting punches 104 are lowered to cut the wire material W , so that the stopper S with a constant length whose both ends are sharpened in a fork shape are obtained. At the time of this cutting, a non-illustrated wire-material-guiding portion, which is incorporated into the column 106 and a part of the column 106, serves as a die. After the wire material W is cut, the cutting punches 104 are further lowered, and the opposite cutting edge portions 104*a* bend both ends of the wire material piece W' around the bender 103 so as. to form it into a U shape.

Upper portions which are about ⅓ of the cutting punches 104 are respectively composed of plate-shaped blocks 104*b* which are extended towards an introducing side of the fastener chain C. The blocks 104*b* and the block 107 are connected with each other by two links 110 and 111. Further, a first plate cam 112 having a cam surface 112*a*, which guides a connected node portion of the links 110 and 111, is arranged at a chain-upstream side of the links 110 and 111 in such a manner that the cam surface 112*a* faces the connected node portion of the links 110 and 111. Moreover, a second plate cam 113 having a cam surface 113*a* at the chain-upstream side is arranged extending from the plate-shaped blocks 104*b* to the lower ends of the cutting punches 104.

Furthermore, in the column 106, an upper end of the bender 103 is pivotally supported to a part of the column 106 via a shaft so as to confront with the cam surface 113*a* of the second plate cam 113. The cam contact surface of the bender 103 is urged in one direction by a non-illustrated urging means, so that the cam contact surface contacts with the cam surface of the second plate cam 113. The bender 103 is composed of a plate material having a substantially boot-shape, and its toe portion moves into and out of a gap between the pair of the cutting edge portions 104*a* of the cutting punches 104 by the pivotal movement of the bender 103. The bender 103 composes a support bent portion of the wire material piece W'. Moreover, the cam contact surface of the bender 103 is composed of a plurality of continuous bent surfaces.

Here, the stopper S of the present embodiment can be attached to the stopper-attaching position of the fastener chain C by cutting and bending the wire material W into a substantially U shape and by fixing it by means of the forming punch 105 and the forming die 102. A material, which is previously formed to be a stopper S bent into a substantially U shape, may be supplied and fixed by the forming die. In this case, the bender 103 is not required.

The space-forming unit 200 is the most characteristic part of the present invention. The unit 200 has fixed grippers 202, movable grippers 203, fixed cutters 204, a knockout 205 and a punch 206. Its peculiar structure makes it possible to form a space in the coil-shaped continuous coupling elements E, simultaneously with the attachment of the stopper S by cooperation with the stopper-attaching unit 100.

The above structure will be described in detail below with reference to FIGS. 1, 3 and 8 through 11.

A pair of the fixed grippers 202, which compose a part of the fastener-chain-transfer path and are spaced from each other in a lateral direction perpendicularly to the transfer direction, are fixed to a base 201 of the space-forming unit 200. A pair of movable grippers 203, which are spaced from each other in the same lateral direction, are arranged above the fixed grippers 202. The movable grippers 203 can be moved up and down with respect to the fastener-chain-transfer path by a fluid cylinder. Moreover, a pair of opposite fixed cutters 204 having cutting edge portions 204*a* at their upper portions are fixed between the paired opposite fixed grippers 202 below the fastener-chain-transfer path.

Furthermore, there is provided a plate-shaped knockout 205 which is moved up and down by a non-illustrated fluid cylinder between the right and left fixed grippers 202 and between the movable grippers 203, passing through the right and left fixed cutters 204.

Still further, a plate-shaped punch 206 is arranged between the opposite movable grippers 203 so as to face the knockout 205 via the fastener-chain-transfer path. The punch 206 is lowered by a fluid cylinder 20 and compression springs 208 between the opposite movable grippers 203, accompanying with the movable grippers 203, until the movable grippers 203 are brought into contact with the fastener chain C stopping on a surface of the fixed grippers 202. Then, thereafter the punch 206 is further lowered by the fluid cylinder 20 so as to push down the coupling head portions of the coupling elements E at the time of the cutting.

The paired opposite fixed grippers 202 respectively has a rectangular block shape. The opposite fixed cutters 204 are fixed between the fixed grippers 202 so as to face each other, and the knockout 205 intervenes in a gap between the fixed cutters 204. The fixed cutters 204 and the knockout 205 are respectively made of plate members. All these members have lengths substantially equal to a dimension L as a length of a space formed on the fastener chain C as shown in FIG. 12. The end surfaces of these members on one side are flush with each other in such a manner that they contact with the adjacent end surfaces of the base 201 as well as the base 101 and the forming die 102 of the stopper-attaching unit 100. The knockout 205, which is the only variable member among these members, can be moved up and down by a ram 209 arranged on a floor section and compression springs 210.

The movable grippers 203 are housed in an inner hollow section of a cylindrical guide member 207 for guiding and holding the grippers 203 up and down. The paired opposite movable grippers 203 have identical reversed T shapes, and each of their slide lever sections 203*a* is in a shape of a hollowed rectangular. A gripper main body made of a substantially rectangular solid having a dimension equal to the length dimension of the space is provided perpendicularly to each of lower ends of the slide lever sections 203*a*. Moreover, the cylindrical guide member 207 has a U-shaped cross section, and for its opening surface at a short side thereof, the column end surface, which is flush with the end surfaces of the cutting punches 104 of the stopper-attaching unit 100, serves as one guide surface of the cylindrical guide member 207. A maximum length of long sides of the guide member 207 is set equal to the length dimension of the space. Meanwhile, a cross section of the slide lever section 203*a* has a substantially square frame shape, and the two slide lever sections 203*a* are inserted from lower ends of the cylindrical guide member 207 into the inner hollow portions thereof, with the punch 206 nipped therebetween.

The punch 206 made of a plate material is also formed into a reverse T shape which is the same as the shape of the movable grippers 203, and it is composed of a slide lever section 206*a* and a punch main body 206*b*. The punch 206 is arranged between the paired opposite movable grippers 203. When their slide lever sections 203*a* are inserted into the hollow portions of the cylindrical guide members 207 from the lower ends thereof, the respective gripper main bodies and the punch main body 206*b* are exposed outside from the lower ends of the cylindrical guide members 207, and their forward and backward end surfaces in the chain-transfer direction are flush with the forward and backward end surfaces of the cylindrical guide members 207 in the same direction.

Furthermore, upper ends of the paired compression springs 208 are fixed to a retainer 211 having a single cubic shape, while lower ends of the compression springs 208 are fixed to bottom surfaces of the hollow portions of the slide lever sections 203*a*. Meanwhile, slits 207*a* for lowering and guiding the retainer 211 by a predetermined distance are formed on upper portions of the facing side walls of the cylindrical guide members 207. A stop arm which is elastically urged from above is horizontally inserted into the slit 207*a* on a chain-downstream side of the slits 207*a*. When an external force is not applied to the retainer 211 from above, the retainer 211 is supported from below in a fixed position by the stop arm. At this time, the gripper main bodies of the movable grippers 203 are positioned above the base 201 with a space for allowing the stopper of the fastener chain C to pass.

With such a structure of the movable grippers 203 and the punch 206, the fluid pressure cylinder 20 is actuated to push down the retainer 211, the punch 206 is lowered, and the movable grippers 203 are also lowered by elastic forces of the compression springs 208. When the movable grippers 203 come to contact with the surface of the fastener chain C below and the compression springs 208 are compressed, the movable grippers 203 come to hold the opposite fastener tapes T between the fixed grippers 202 and the movable grippers by means of the elastic forces of the compression springs 208. The punch 206 further moves down to push the head portions of the coupling elements E against the fixed cutters 204 below so as to cut the leg portions of the coupling elements E in an area equal to the length dimension of the space.

Figure 1:
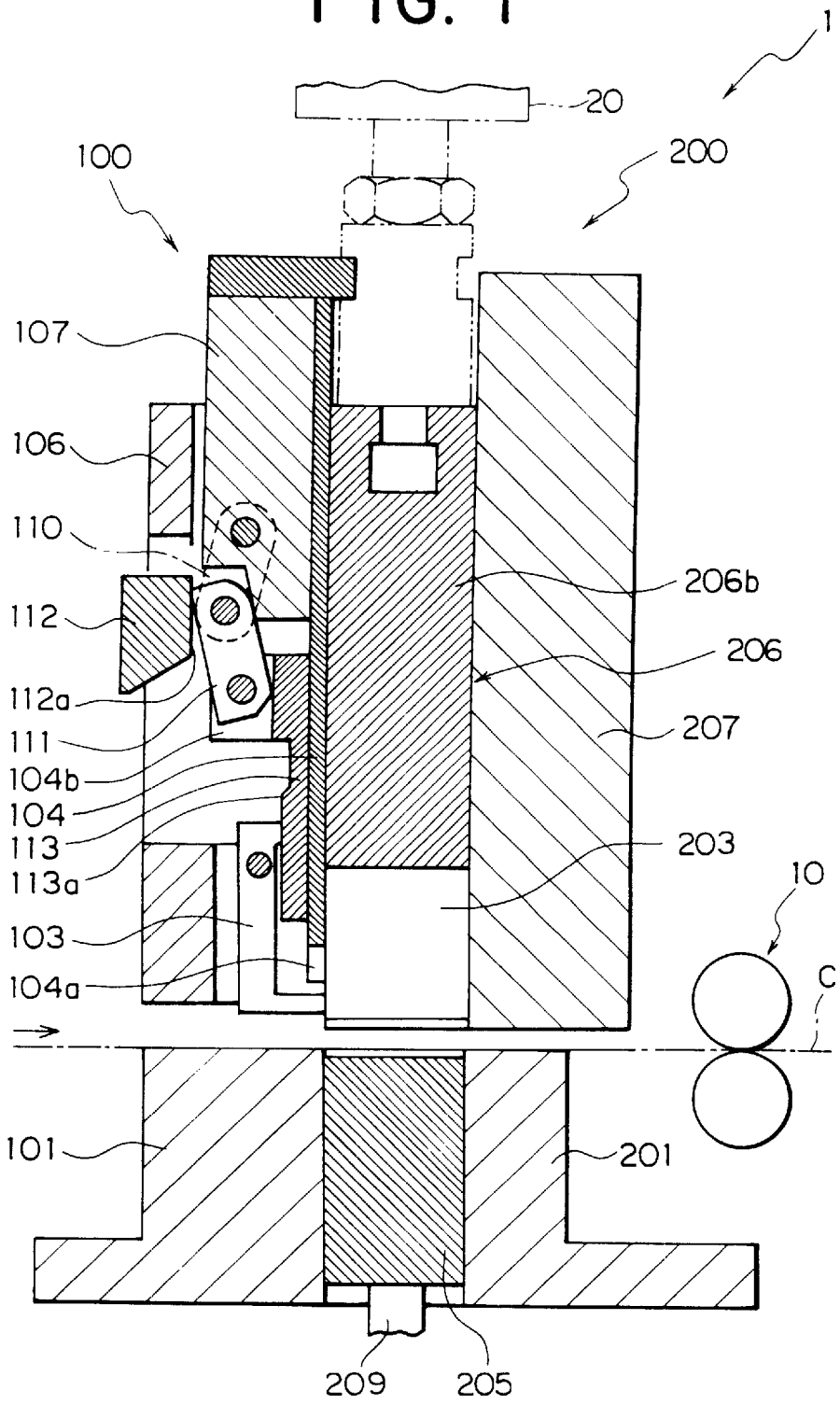
FIG. 1 is a longitudinal sectional view showing an example of an entire structure of a fastener-chain-finishing apparatus of the present invention.

In such a manner, it is possible to make the one end surface of the space-forming unit 200 brought into contact with the one end surface of the stopper-attaching unit 100 on the same vertical surface, which is the most important characteristic in the present invention. In other words, as is understood from FIG. 1, in the stopper-attaching unit 100, the end surfaces of the forming die 102 and the column 106 are arranged so as to correspondingly contact with the end surfaces of the fixed grippers 202 and the cylindrical guide member 207 for the movable grippers 203. The base 101 and the column 106 of the stopper-attaching unit 100 are connected and fixed respectively to the base 201 and the cylindrical guide member 207 of the space-forming unit 200 by a beam. Moreover, the driving block 107 of the stopper-attaching unit 100 and the movable grippers 203 of the space-forming unit 200 are simultaneously actuated by the single fluid pressure cylinder 20 as shown in FIG. 1.

There will now be described below steps of attaching a stopper S and steps of forming a space by the apparatus of the present invention having the above structure with reference to FIGS. 4 through 11. The fastener chain C is transferred intermittently, per predetermined length, on the chain transfer path by the chain-supply apparatus 10. When the transfer of the fastener chain C is stopped, the fastener chain C is positioned and fixed in the fixed position by a well known positioning means. Then, the fluid pressure cylinder 20 is actuated so as to lower the driving block 107 and simultaneously lower the movable grippers 203 and the punch 206 as in the above-mentioned manner. There will now be described below the operations for attaching the stopper S and for forming the space respectively by means of the stopper-attaching unit 100 and the space-forming unit 200 with reference to the drawings.

FIGS. 4 through 7 are views for explaining the operations of the operating members viewed from the front thereof, showing the steps of attaching the stopper S to the fastener chain C by means of the stopper-attaching unit 100.

FIG. 4 is a drawing showing a state in which the wire material W is supplied and is in a stand-by state. When the driving block 107 is started to be lowered, simultaneously the forming punch 105 is lowered at the same speed. At this time, the connected node portion of the two links 110 and 111 is brought into contact with a vertical portion of the cam surface 112 of the first cam 112 as shown in FIG. 1, and while a distance between the driving block 107 and the cutting punches 104 is kept constant, the cutting punches 104 are also lowered.

Figure 2:
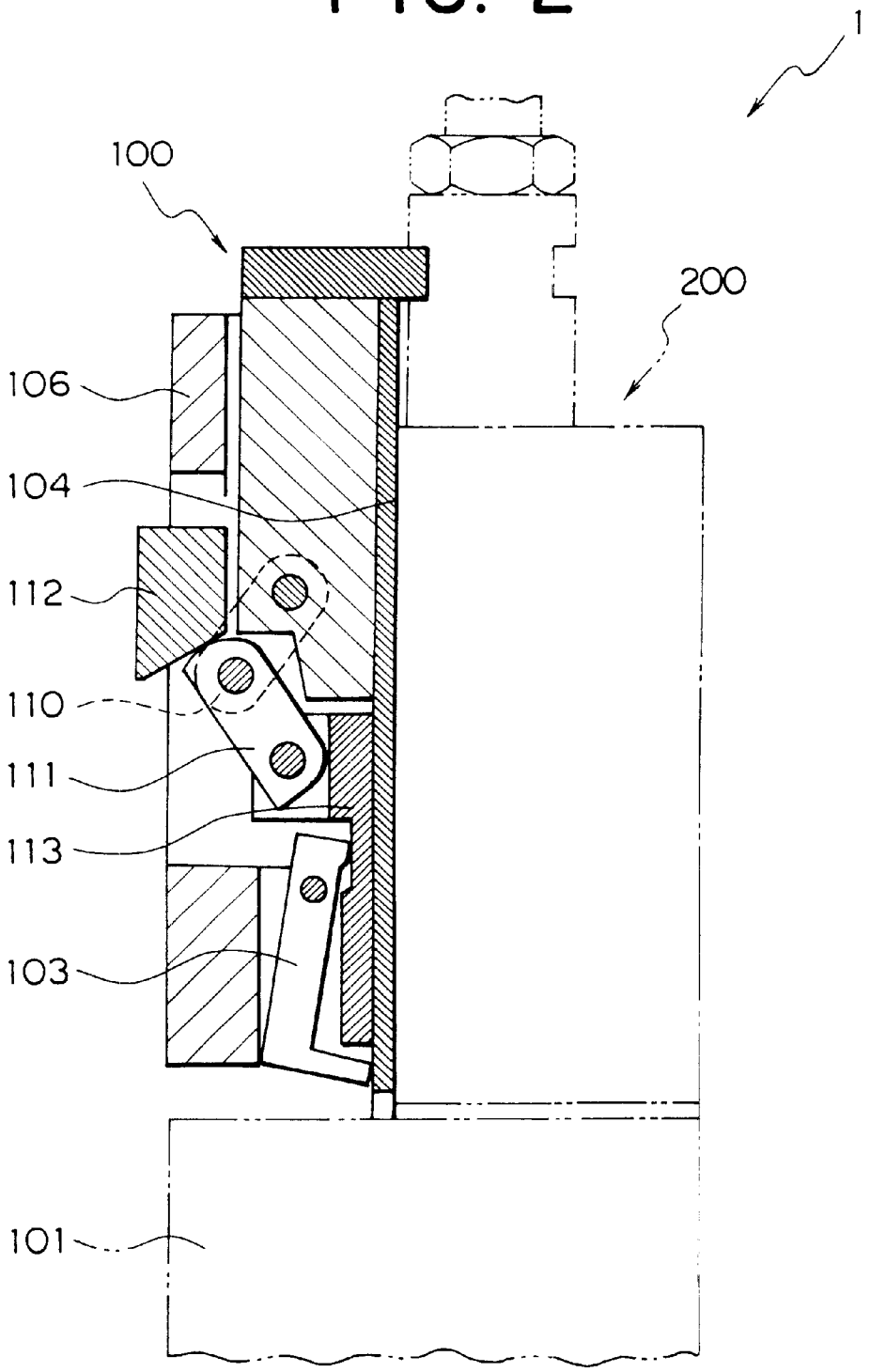
FIG. 2 is a longitudinal sectional view of a stopper-attaching unit in the finishing apparatus.
Figure 3:
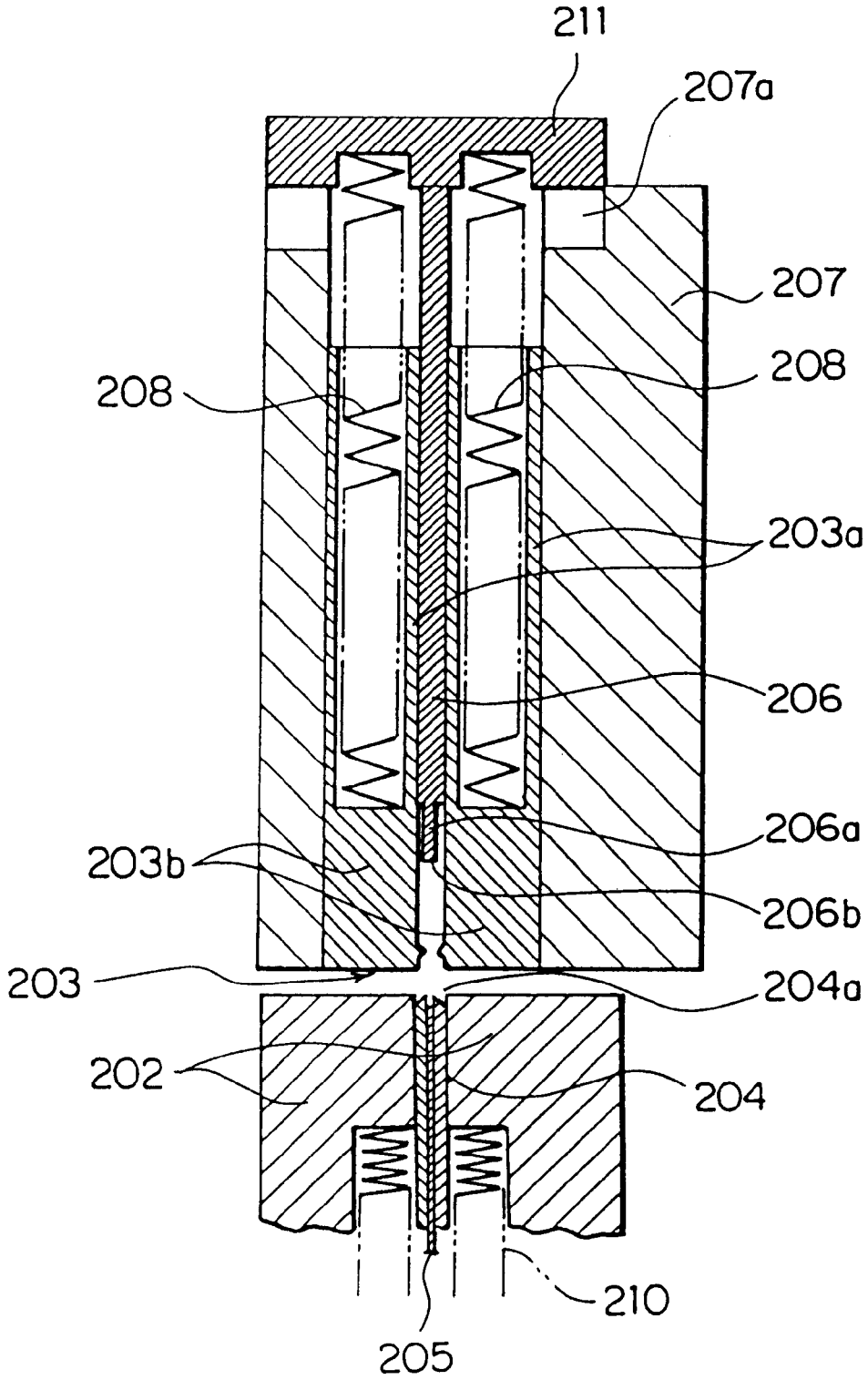
FIG. 3 is a longitudinal section of a space-forming unit in the finishing apparatus.

At the time of this lowering, the contact surface of the bender 103 is in contact with the cam surface 113*a* of the second plate cam 113 fixed to the punch 104 until the cutting punches 104 cut and bend the wire material W. The bender main body 103*a* of the bender 103 is stopped at a position where the wire material W is to be supported from below. Even when the cutting and bending of the stopper wire material W are completed, the lowering of the cutting punches 104 is maintained. However, as shown in FIG. 5 just when the bending is completed, the contact surface of the bender 103 with the second cam surface 113*a* is changed, and as shown in FIG. 2 the bender 103 is rotated fulcruming its upper end so that the bender main body 103*a* retreats from the wire material supporting portion.

Figure 6:
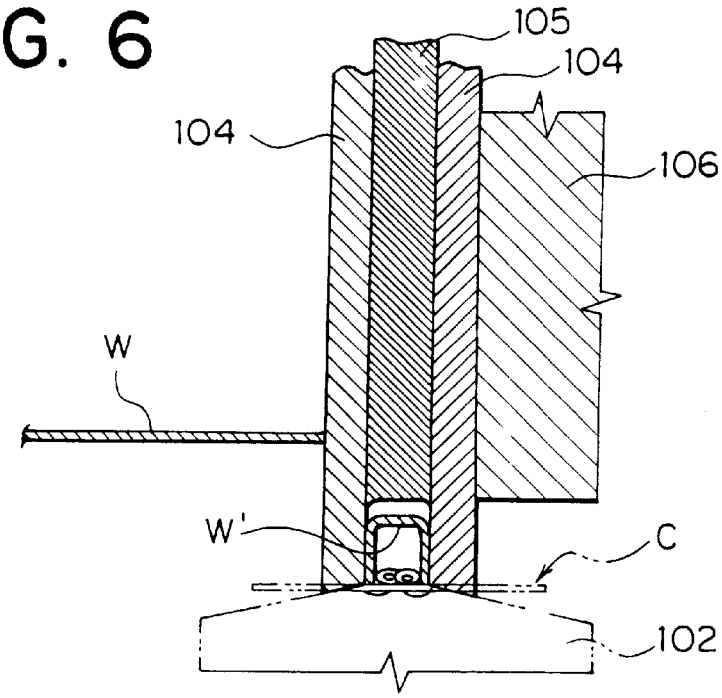
FIG. 6 is a view for explaining the operations of the members when driving of the stopper wire material piece to be a stopper is started by the stopper-attaching unit .
Figure 7:
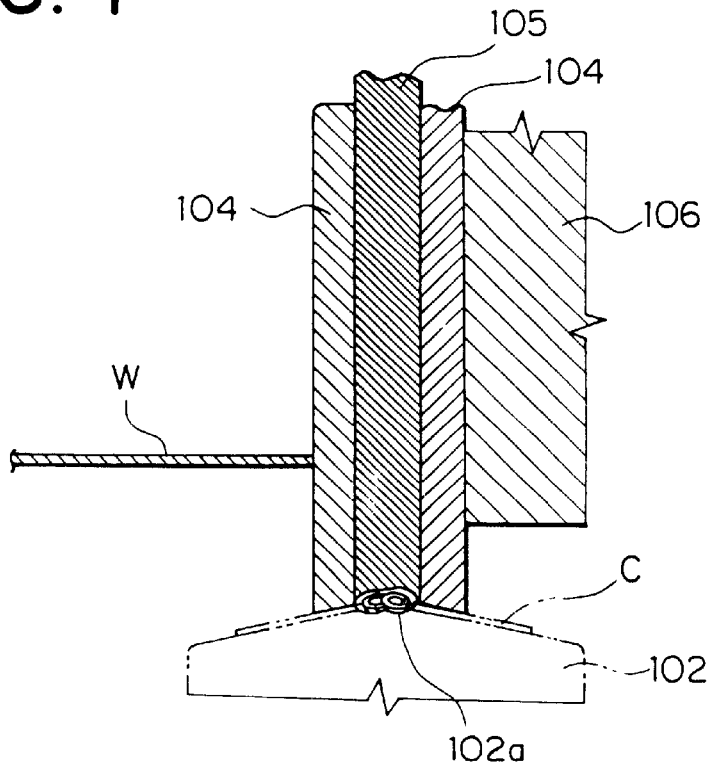
FIG. 7 is a view for explaining the operations of the members when the attachment of the stopper is completed by the stopper-attaching unit .

Even after the bender main body 103*a* retreats, the cutting punches 104 are further lowered until they come into contact with the upper surface of the forming die 102 via the fastener chain C (FIG. 6). When the lower end slanted surfaces of the cutting punches 104 come in contact with the fastener chain C stopping on the upper surface of the forming die 102, the contact surface of the connected node portion of the two links 110 and 111 with the cam surface 112*a* of the first plate cam 112 is changed so that the connected node portion is greatly bent as shown in FIG. 2. As a result, only the forming punch 105 is further lowered via the driving block 107. When the forming punch 105 is lowered, both the bent ends of the wire material piece W' astride of the coupling elements E pierces the fastener tape T and are bent inwardly by a bending portion 102*a* of the forming die 102 at the back surface of the fastener chain C, thus the stopper S is fixed to the tape (FIG. 7).

At the same time when the stopper S is attached to the fastener chain C in such a manner, a space is formed by the space-forming unit 200 at a position close to the attaching position of the stopper S. FIGS. 8 through 11 show the steps of forming the space.

Figure 8:
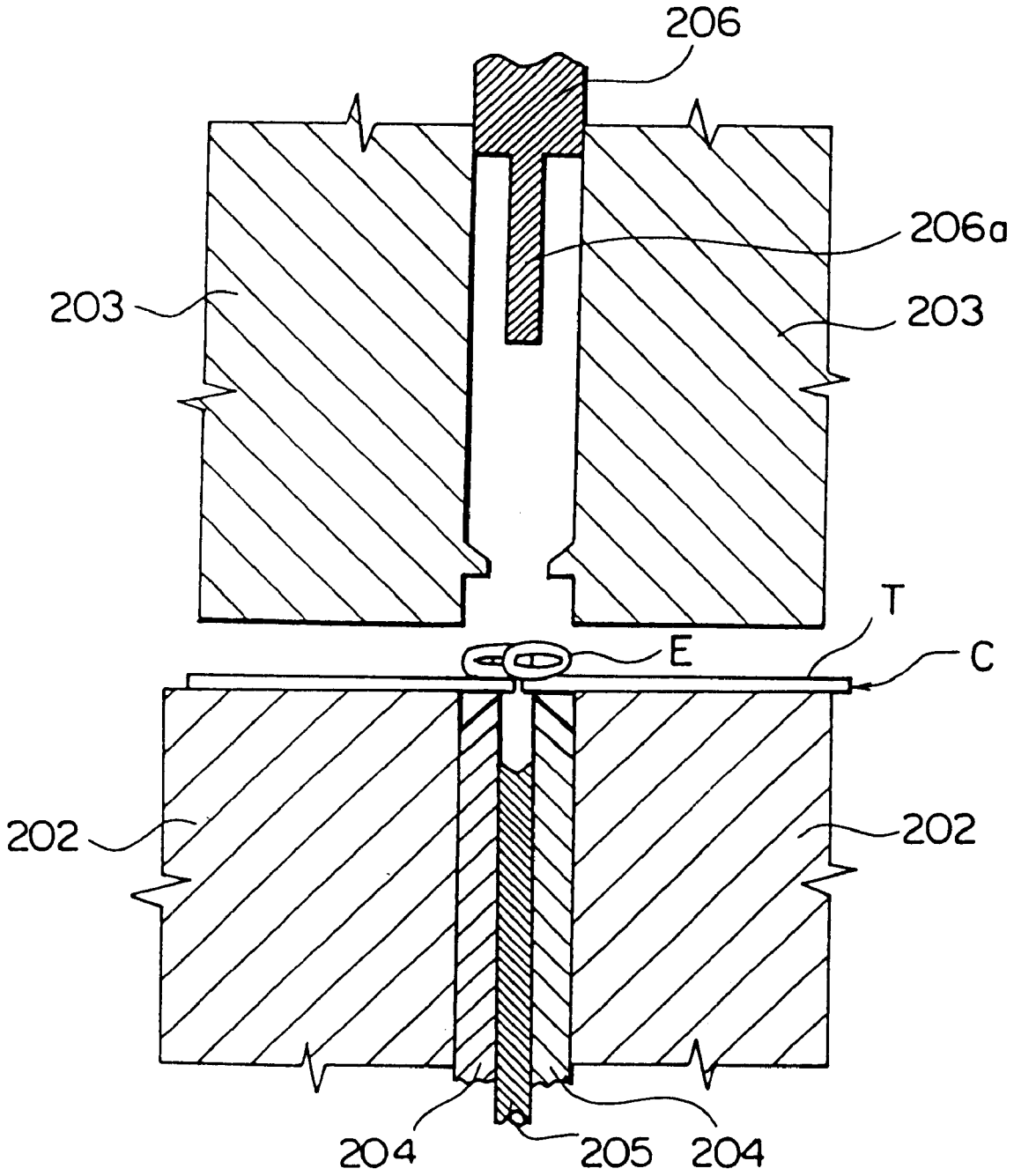
FIG. 8 is a view for explaining operations of respective members when forming of a space is started by the space-forming unit.
Figure 9:
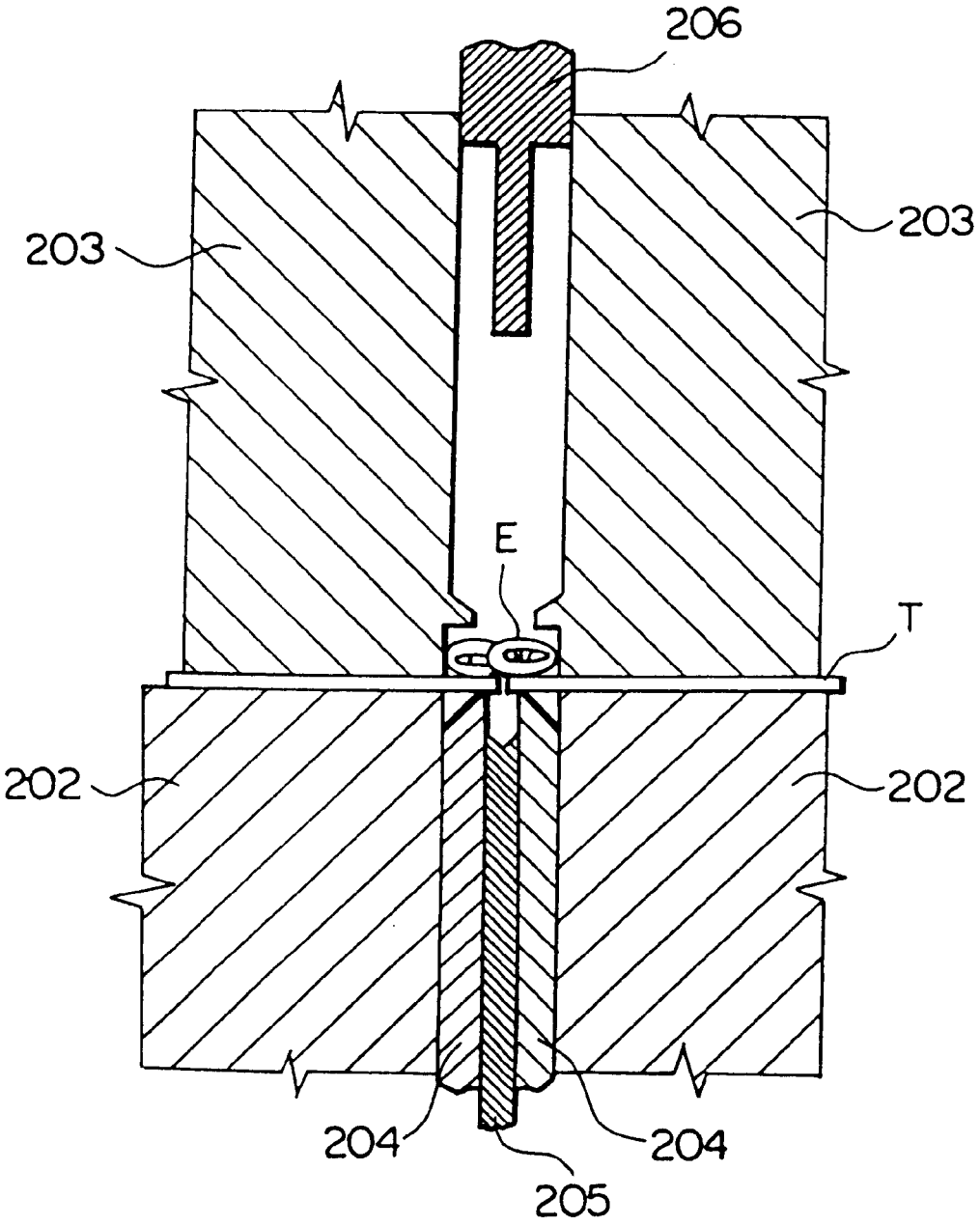
FIG. 9 is a view for explaining the operations of the members when the fastener chain is held by the space-forming unit.

FIG. 8 shows a state in which the movable grippers 203 are standing by in an upper position where the fastener chain C stopping on the upper surface of the fixed grippers 202 does not interfere with the coupling elements E. In this state, when the fluid pressure cylinder 20 starts to operate (FIG. 1), a rod end of the cylinder 20 pushes down the upper surface of the retainer 211 so as to lower the movable grippers 203, without compressing the compression springs 208 until the surfaces of the gripper main bodies of the movable grippers 203 are fitted on the surfaces of the fixed grippers 202 via the fastener chain C (FIG. 9). At this time, the punch 206 is also pushed to be lowered together with the movable grippers 203 by the retainer 211 (FIG. 9).

Figure 10:
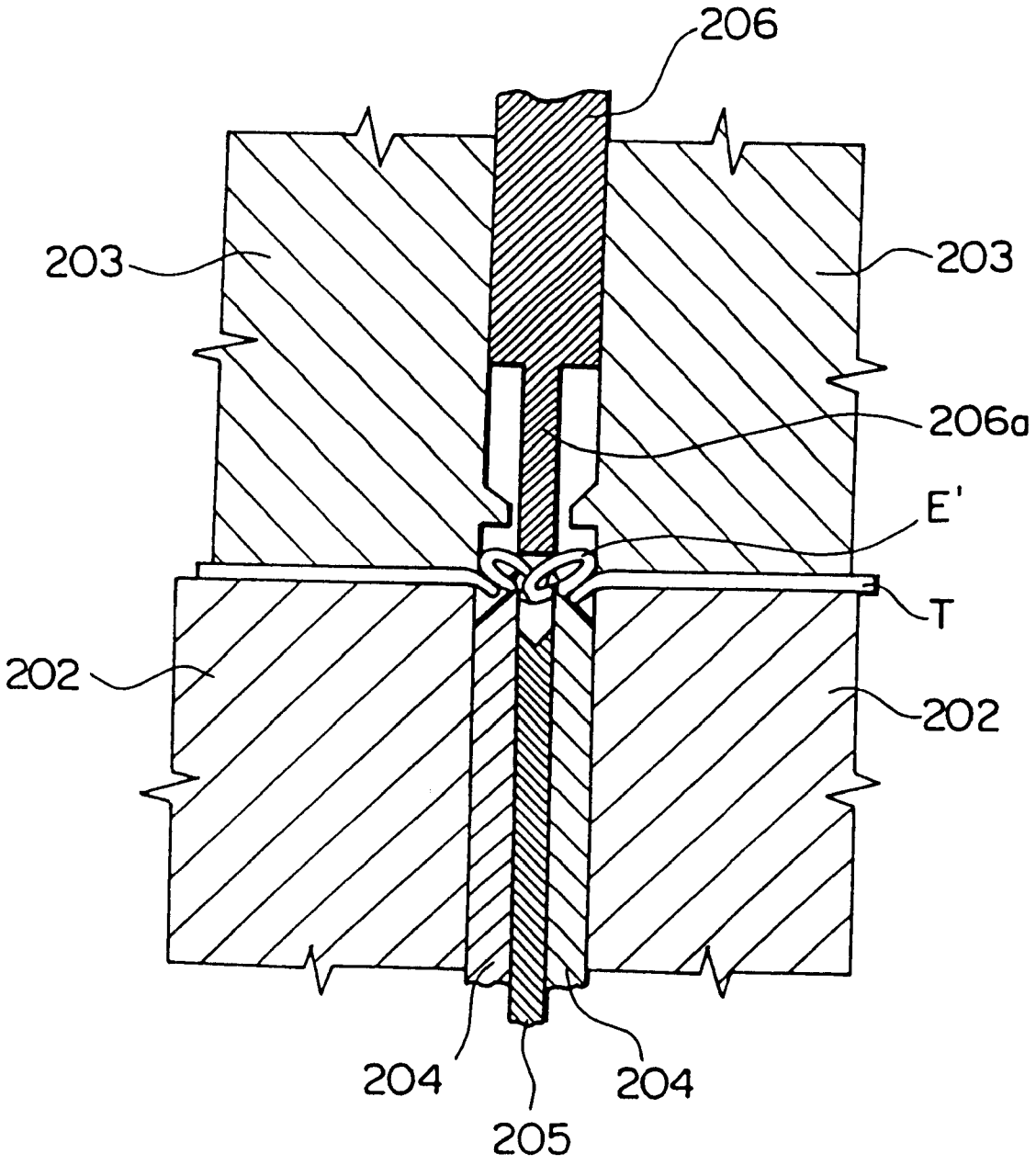
FIG. 10 is a view for explaining the operations of the members when coupling elements are cut by the space-forming unit.

When the lowering of the movable grippers 203 is completed, the compression springs 208 are compressed by the retainer 211, so that the movable grippers 203 strongly hold the opposite fastener tapes T between the fixed grippers 202 and the movable grippers 203 by means of the elastic force. Even during this holding, the punch 206 keeps lowering to press the head portions of the coupling elements E against the fixed cutters 204 below and cut the lower leg portions of the coupling elements E in an area equal to the length dimension of the space (FIG. 10).

Figure 11:
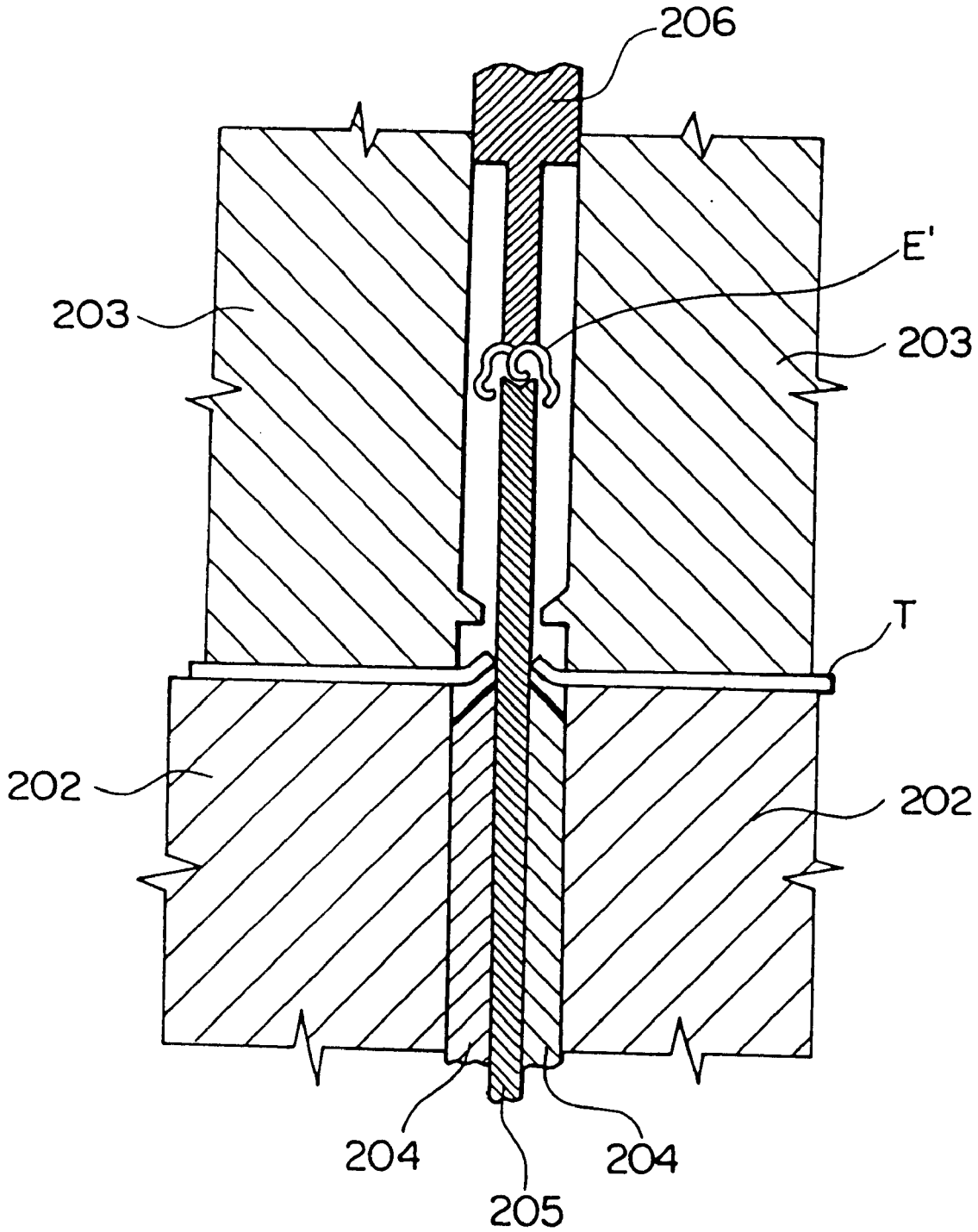
FIG. 11 is a view for explaining the operations of the members when the coupling elements are removed by the space-forming unit.

When the cutting of the lower leg portions of the coupling element E is completed, the ram 209 arranged on the floor section is lifted to ascend the knockout 205, and the cut coupling element pieces E are nipped between the lower end of the punch 206 standing by above and the knockout 205 below. Thereafter, the fluid pressure cylinder 20 is actuated in its contracting/extending direction, synchronously with the ram 209, so that the retainer 211 is lifted to finally pull up the movable grippers 203, and the cut coupling element pieces E' are drawn out of the sewing thread (FIG. 11). Thereafter, the coupling element pieces E' are attracted to be removed from the apparatus by a known element-attracting means. Then, the ram 209 is returned to its standby position by the elastic forces of the compression springs 210.

As is clear from the above description, according to the fastener-chain-finishing apparatus of the present invention, only the knockout 205 of the plural members provided below the chain-transfer path of the space-forming unit 200 can be moved up and down, and all the other members are fixed so that the units below the chain-transfer path can become compact. Further, in the main bodies of the movable grippers 203 and punches 206, which have a length substantially equal to the length of the space and, are arranged above the chain transfer path, their end surfaces at least on the side of the stopper-attaching unit 100 provided adjacently thereto are exposed outside and the exposed surfaces are flush with each other. As a result, the space-forming members can be arranged close to the stopper-attaching members of the stopper-attaching unit 100, so that the space can be formed in a predetermined portion of the fastener chain C to which coil-shaped continuous coupling elements are attached via by sewing thread approximately simultaneously with the attachment of the stopper S, which was impossible to achieve in the prior art.

What is claimed is:

1. A fastener-chain-finishing apparatus, comprising:

a chain-supply means for intermittently supplying a continuous fastener chain in which a pair of rows of coupling elements in a coil shape are attached along inner side edges of a pair of opposite fastener tapes by sewing;

a stopper-attaching unit which is arranged on a transfer path of the fastener chain and fixes stoppers to the supplied fastener chain at a predetermined interval; and a space-forming unit which is arranged adjacent to said stopper-attaching unit at the transfer path of the fastener chain and removes the coupling elements of a predetermined length from the fastener chain with the pair of rows of coupling elements in the coupled position, wherein said stopper-attaching unit includes, at least, a forming die arranged on a base, and a forming punch for installing the stoppers to the fastener chain, said space-forming unit includes a pair of fixed grippers fixed to a base, spaced from each other in a lateral direction of the fastener-chain-transfer path, a pair of movable grippers spaced from each other in said lateral direction and being movable up and down with respect to the fastener-chain-transfer path in cooperation with each other, a pair of opposite fixed cutters arranged between said pair of opposite fixed grippers and having cutting edge portions at their upper portions, a knockout for passing through the opposite fixed cutters and moving up and down between the fixed grippers and between the movable grippers, and a punch arranged so as to face the knockout and being movable up and down independently between the opposite movable grippers so as to push down coupling head portions of the coupling elements at the time of processing, the knockout and the punch ascending after the elements are cut;

wherein the opposite movable grippers and the punch of said space-forming unit respectively have slide lever sections for moving up and down along inner wall surfaces of a cylindrical guide member having an end surface at a side of vertical surfaces, and gripper main bodies and a punch main body that are respectively joined to lower ends of the lever sections and are extended to the end surfaces of the side of the vertical surfaces; and wherein respective lengths of respective members, are set to be substantially equal to a length dimension of a space-forming area of the fastener chain, and end surfaces of the members at least on one side thereof share the vertical surfaces in common with one-side end surfaces of the forming die and the forming punch adjacent to the members in the direction of the chain-transfer path whereby the end surfaces of the members are in tight contact with the end surfaces of the forming die and the forming punch, the members include but are not limited to at least one of the following;

the fixed grippers, the movable grippers, the fixed cutters, the knockout and the punch in a direction of the fastener-chain-transfer path.

2. A fastener-chain-finishing apparatus according to claim 1, wherein said stopper-attaching unit further includes a bender for advancing and retreating along the fastener chain with respect to a supporting portion of a wire material for forming stoppers, and cutting punches for cutting the wire material supplied onto the bender into a predetermined length and a shape, and in that the forming punch is arranged so as to face the forming die for moving up and down with respect to the forming die so that a cut wire material piece can be formed into a stopper shape and for installing the stopper to the fastener chain.

3. A fastener-chain-finishing apparatus according to claim 1, wherein end surfaces of the cutting punches of the stopper-attaching unit at said vertical surface side are provided to be slidable against the end surface of the cylindrical guide member adjacent to the cutting punches.

4. A fastener-chain-finishing apparatus according to claim 3, wherein the slide lever sections of the movable grippers have angular cylindrical shapes where their upper ends are opened, and lower ends of springs are fixed in hollows of the slide lever sections, and upper ends of the springs are fixed to a retainer.

5. A fastener-chain-finishing apparatus according to claim 3, wherein the cylindrical guide member of the space-forming unit and the cutting punches of the stopper-attaching unit are actuated by one fluid pressure cylinder.

* * * * *

UNITED STATES PATENT AND TRADEMARK OFFICE

CERTIFICATE OF CORRECTION

PATENT NO. : 6,467,159 B2
DATED : October 22, 2002
INVENTOR(S) : Shimai et al.

It is certified that error appears in the above-identified patent and that said Letters Patent is hereby corrected as shown below:

Title page,
Item [73], Assignee, "Ykk Corporation" should read -- YKK Corporation --.

Signed and Sealed this

Fifth Day of August, 2003

JAMES E. ROGAN
*Director of the United States Patent and Trademark Office*